US010971117B2

(12) United States Patent
Merkoci et al.

(10) Patent No.: US 10,971,117 B2
(45) Date of Patent: Apr. 6, 2021

(54) DEVICE AND METHOD FOR DAMPING OF ALIQUOT TONES

(71) Applicants: Antun Merkoci, Sredisce Ob Dravi (SI); Ales Bracic, Sredisce Ob Dravi (SI)

(72) Inventors: Antun Merkoci, Sredisce Ob Dravi (SI); Ales Bracic, Sredisce Ob Dravi (SI)

(73) Assignee: Antun Merkoci and Ales Bracic, Sredisce Ob Dravi (SI)

( * ) Notice: Subject to any disclaimer, the term of this patent is extended or adjusted under 35 U.S.C. 154(b) by 0 days.

(21) Appl. No.: 16/758,984

(22) PCT Filed: Oct. 18, 2018

(86) PCT No.: PCT/SI2018/050033

§ 371 (c)(1),
(2) Date: Apr. 24, 2020

(87) PCT Pub. No.: WO2019/083462

PCT Pub. Date: May 2, 2019

(65) Prior Publication Data

US 2020/0349908 A1 Nov. 5, 2020

(30) Foreign Application Priority Data

Oct. 24, 2017 (SI) ..... P-201700286

(51) Int. Cl.
*G10C 3/166* (2019.01)
*G10C 3/20* (2006.01)

(52) U.S. Cl.
CPC ..... *G10C 3/166* (2013.01); *G10C 3/20* (2013.01)

(58) Field of Classification Search
CPC ..... G10C 3/166; G10C 3/20
See application file for complete search history.

(56) References Cited

U.S. PATENT DOCUMENTS 2,237,990 A * 4/1941 Hewlett ..... G10C 3/166 84/219
2,900,862 A * 8/1959 Getz ..... G10B 3/14 84/426

(Continued)

*Primary Examiner* — Robert W Horn
(74) *Attorney, Agent, or Firm* — The Watson IP Group, PLC; Jovan N. Jovanovic

(57) ABSTRACT

The object of the invention is a device and a method for damping of aliquot tones, which solve the technical problem of the damping of aliquot tones in instruments that have a large number of strings (6) mounted between two fastening points (7) of the string, wherein a musician does not touch the strings (6) with his fingers or with a hand-held accessory. Such instruments are for instance the piano and the upright piano. The invention is technically configured in a way that the string (6) proximal to one of both fastening points (7) of the string, via the actuator (4), is pressed with the pressing material (2) which is preferably an elastic material, wherein the pressing of the pressing material (2) causes the damping of aliquot tones. The device (1) for damping of aliquot tones comprises at least the pressing material (2), with which the pressure against the strings (6) is carried out by way of the pressing element (8), the movable element (3) which causes a pressing force, and the actuator (4) linked to the linkage (5), with which the pressure against the strings (6) is actuated, thus dampening the aliquot tones.

9 Claims, 1 Drawing Sheet

(56) References Cited

U.S. PATENT DOCUMENTS

Figure 1:
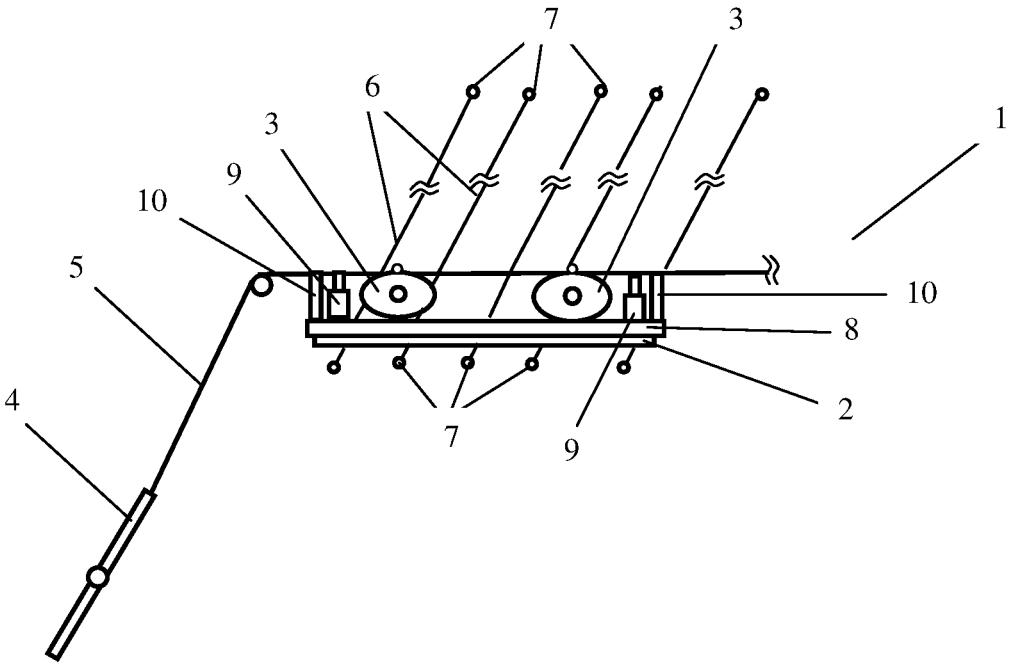

| | | | | |
|---|---|---|---|---|
| 4,324,164 | A * | 4/1982 | Monte | G10C 3/20 84/744 |
| 4,970,929 | A * | 11/1990 | Ishida | G10C 3/166 84/220 |
| 5,022,302 | A | 6/1991 | Guyon | |
| 6,265,647 | B1 * | 7/2001 | Tamaki | G10C 5/10 84/216 |
| 6,683,242 | B2 * | 1/2004 | Inoue | G10C 5/10 84/719 |
| 8,148,620 | B2 * | 4/2012 | Jones | G10C 5/10 84/423 R |
| 8,247,672 | B2 * | 8/2012 | James | G10C 3/00 84/255 |
| 8,541,673 | B2 * | 9/2013 | Jones | G10C 5/10 84/243 |
| 10,762,879 | B2 * | 9/2020 | Liu | G10C 1/04 |
| 2004/0007116 | A1 | 1/2004 | Marcus | |
| 2017/0132992 | A1 * | 5/2017 | Caporali | G10C 3/20 |
| 2018/0204544 | A1 * | 7/2018 | Webman | G10C 3/166 |
| 2019/0272808 | A1 * | 9/2019 | Terai | G10C 3/166 |
| 2020/0349908 | A1 * | 11/2020 | Merkoci | G10C 3/166 |

* cited by examiner

DEVICE AND METHOD FOR DAMPING OF ALIQUOT TONES

DESCRIPTION OF THE INVENTION

Field of Invention

Aliquot tones; damping of aliquot tones; string instruments; piano; upright piano.

Technical Problem

String instruments are instruments provided with several strings, each of which is mounted between two rigid fastening points. One of the rigid fastening points enables tightening of a string, which allows tuning of each individual string. The number of various tones of an instrument depends on the number of strings.

Each string has its fundamental tone and aliquot tones. Aliquot tones have various names, such as consonant tones, accessory tones, partial tones, overtones. Aliquot tones are faintly heard consonant tones produced with the fundamental tone of an individual string. The fundamental tone and the aliquot tones together form the sound of a string or the consonance of tones, which is crucial for the timbre of the fundamental tone.

The sound of each string consists of a fundamental tone and aliquot tones. The device for damping of aliquot tones changes the timbre of the fundamental tone, thus providing a new sound register in relation to the known variants of pianos and upright pianos known so far.

PRIOR ART

The commercially available pianos and upright pianos have a certain number of strings, wherein each string produces its fundamental tone and aliquot tones. The fundamental tone and the aliquot tones produce the sound of a string, which is crucial for the timbre of the fundamental tone.

A device that would dampen the aliquot tones in pianos and upright pianos has not been found either on the market or in literature.

DESCRIPTION OF THE NEW SOLUTION

The object of the invention is a device and a method for damping of aliquot tones in instruments that have a large number of strings mounted between two fastening points, and in which a musician does not touch the strings with his fingers or with a hand-held accessory, preferably for damping of aliquot tones in the piano or the upright piano.

A sound in the piano or the upright piano is produced by striking a key that actuates a lever mechanism with a hammer that strikes a string and vibrates it.

The tone or the sound of a string is determined by the fundamental tone and the aliquot tones, wherein the aliquot tones are faintly heard consonant tones produced with the fundamental tone of an individual string. The consonance of the fundamental tone and the aliquot tones is crucial for the timbre of the fundamental tone.

Some instruments such as the piano or the upright piano have integrated means for a complete dampening of string tones (dampers), with which the strings are completely dampened/made still and the tone or the sound of a string can no longer be heard. On the piano or the upright piano, the means for a complete dampening of strings (damper) is deactivated by striking a key, while the damper is reactivated (dampens the string) when the key is released.

The device of the invention does not completely dampen the tone but dampens only the aliquot tones, thus changing the timbre of the fundamental tone and providing a new sound register.

According to the invention, pressure is applied on the initial or final part of the active part of a string having a pressing material, by an actuator, wherein the pressure of the pressing material causes a change in the string vibration and consequently dampening of the aliquot tones.

The pressing material is preferably an elastic material selected from the materials that get slightly deformed when loaded, i. e. when pressed against the strings, and part of the elastic material which is in contact with the string gets adapted in its shape to the shape of the string, wherewith the contact surface between the string and the elastic material is increased. Once the elastic material is released, it assumes it initial shape, the deformation is no longer present. In a preferred embodiment, the pressing material is made from silicone rubber.

The device for damping of aliquot tones comprises at least a pressing material, with which pressure is applied on the strings, at least one movable element which causes a pushing force by being moved, such that the pressing material presses against the strings and the movable element actuates at least one return element with its movement, and an actuator, with which the movable element is actuated in that the movable element presses the pressing material against the strings, thus dampening the aliquot tones.

The pressure against the string can be exerted on the initial or final part of the active part of the string, wherein the term active part of the string refers to the part of the string which is mounted between two rigid fastening points.

The actuator actuates (triggers) the movable element through an adequate linkage and the movable element also actuates the return element with its movement. The function of the return element is to return the movable element to its initial position once the actuation is over, thus moving the pressing material away from the strings. In a preferred embodiment, the return element is configured as a spring. The pressing material can be directly fastened to the movable element, in the preferred embodiment, though, the movable element when actuated or moved presses against the pressing element, on which the pressing material is fastened, such that the pressing element with the pressing material presses against the strings. The pressing element is guided by guides, this is why the movement of the pressing element is limited to a direction towards the strings. Once the actuator and the link are no longer active, the movable element ceases to exert pressure on the pressing element and the return element returns the movable element and simultaneously the pressing element with the pressing material to its initial position.

The actuator actuates at least one or several movable elements, wherein the movable elements get triggered/actuated via a linkage in known ways: for instance through a mechanical linkage, such as a cord, a rope, a steel cable, a steel bar or any other mechanical linkage; through an electrical linkage, such as an electrical conductor; through a hydraulic linkage, such as an hydraulic conductor; through a pneumatic linkage, such as pneumatic conductors; or through a wireless linkage, wherein the actuator transmits a wireless signal that triggers the movable elements. The movable elements can be embodied in any way; their task is to cause pressure against the strings when actuated/moved, wherein the pressure against the strings is carried out via the pressing material. Between the pressing material and the movable elements there may be a pressing element, to which the pressing material is fastened, or the pressing material is fastened to the movable elements.

The pressing element enables a simultaneous pressing against one or several strings at the same time. The pressing element is mounted in guides, this is why the movement of the pressing element is limited to a direction towards the strings.

The pressure of the pressing element against a string is carried out by a movement of the movable element, wherein the movable element is moved by a linkage, which may be mechanical, hydraulic, pneumatic, electrical, in short in a mechanical way, by hydraulics, pneumatics, electricity or in any other way, which is not limiting to the essence of the invention.

The pressure against the strings can be actuated in any way, the actuator is preferably formed as a foot pedal, which does not limit the essence of the invention.

The movable element can be of any configuration, it is preferably formed as:

- a mechanical element of a non-circular shape, preferably of an ellipsoidal shape, and the actuation/shift is carried out by rotating the mechanical element around its axis wherein due to the non-circular shape of the mechanical element the point of pressing of the mechanical element changes, more precisely the radius is changed which defines the distance from the turning point of the mechanical element to the point of pressing of the mechanical element,
- the movable element can be formed as a hydraulic cylinder,
- the movable element can be formed as an electromagnet,
- the movable element can be formed as a pneumatic cylinder . . . .

Stepwise actuation of the actuator can dampen various groups of strings in a stepwise manner by gradually turning on the device for damping of aliquot tones by individual groups of strings. If an actuator in the form of a foot pedal is used, the stepwise actuation of the food pedal differently dampens various groups of strings by gradually turning on the device for the damping of aliquot tones by individual groups of strings, in a first step, for instance, the device for the damping of aliquot tones of only high pitch strings is turned on (actuated), in a second step, the device for the damping of aliquot tones of only low pitch strings is turned on (actuated), and in a third step, the device for the damping of aliquot tones of all strings is turned on (actuated).

The invention will be explained in more detail hereinbelow by way of embodiments and the enclosed drawings:

FIG. 1 represents a schematic view of the device for damping of aliquot tones in a first variant, wherein the figure shows a device 1, a pressing material 2, a movable element 3, an actuator 4, a linkage 5, a string 6, a string fastening point 7, a pressing element 8, a guide 9, a return element 10.

Figure 2:
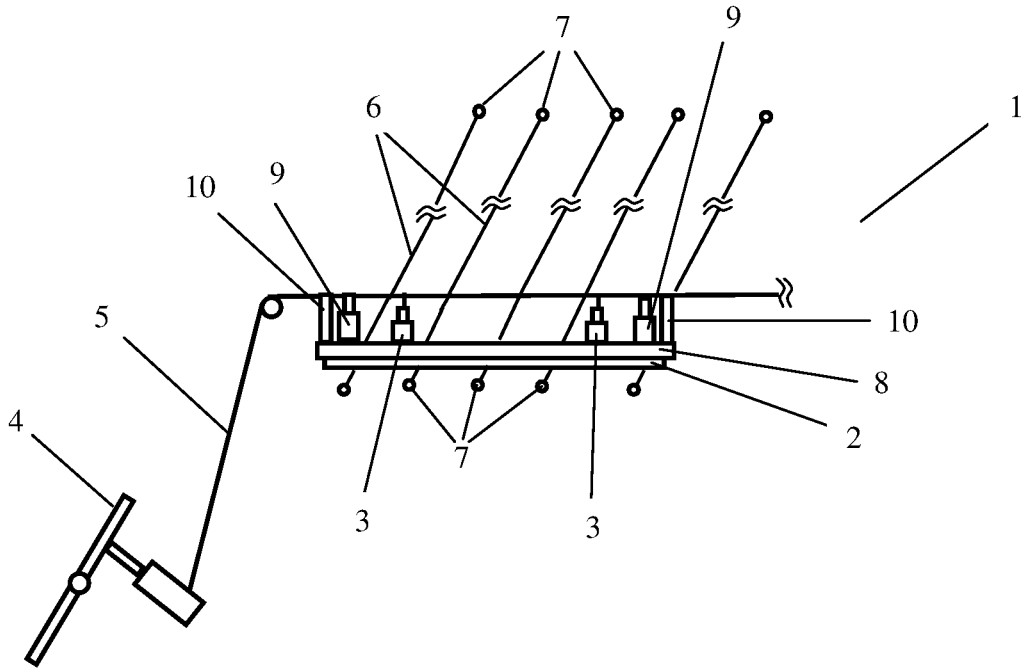

FIG. 2 represents a schematic view of the device for damping of aliquot tones in a second variant, wherein the figure shows a device 1, a pressing material 2, a movable element 3, an actuator 4, a linkage 5, a string 6, a string fastening point 7, a pressing element 8, a guide 9, a return element 10.

The first embodiment is schematically represented in FIG. 1.

The instrument of the embodiment is the piano or the upright piano with an integrated means for complete dampening of string tones (string dampers), with which the strings are completely dampened/made still. The damper is deactivated by striking a key, while it is re-activated (dampens the string) when the key is released.

The device 1 for damping of aliquot tones is technically configured in a way that pressure is applied on a string/strings 6 at the initial or final part of the active part of the string 6, i. e. at the initial fastening point 7 of the string 6 or optionally at the final fastening point 7 of the string 6 via actuator 4, which is a foot pedal in this embodiment. By pressing the actuator 4, the movable element 3 is actuated by the linkage 5, wherein the movable element 3 presses against the pressing element 8 having the pressing material 2 fastened thereon, said pressing material being formed from a silicone rubber in this embodiment, and presses or moves the pressing element 8 towards the strings 6, wherein the pressing material 2 presses against the string 6 and dampens the aliquot tones. The pressing element 8 is guided by the guides 9. As the pressing element 8 is moved, the movable element 3 actuates the return element 10, being a spring in this embodiment, more precisely it stretches it. Once the actuator 4 and hence the linkage 5 are no longer active, the spring returns to its original shape, it compresses, thus returning/moving the movable element 3 to its initial position, wherein the pressing element 8 and the pressing material 2 move away from the strings 6.

When the actuator 4 is actuated, the movable element 3 presses the pressing element 8 having the pressing material 2 fastened thereon against the strings 6. The pressing on the strings 6 is done at the initial or final part of the active part of the string 6, i. e. at the initial or final fastening point 7 of the string 6.

The actuator 4 causes by way of the linkage 5, which is a steel cable in this embodiment, rotation of the movable element 3, which is a mechanical ellipsoidal element in this embodiment, the movement of said movable element pressing/moving the pressing element 8 having the pressing material 2 fastened thereon in direction towards the strings 6. The pressing element 8 is guided by the guides 9. Once the actuator 4 is no longer active, the return element 10, which is a spring in this embodiment, returns the movable element 3 and hence the pressing element 8 to its initial position, thus releasing the pressure of the pressing element 2 against the strings 6.

As shown in FIG. 1, the two movable elements 3, that are mechanical elements of ellipsoidal shape, are fastened to the points of rotation and fastened on the outer radius to the linkage 5, i. e. a steel cable. When the actuator 4, i. e. a foot pedal, is pressed, the steel cable is pulled, wherein the mechanical elements rotate around the centre of rotation. Due to the distance between the centre of rotation of the mechanical element and the point of pressure on the pressing element 8 having the pressing material 2 fastened thereon, getting bigger, the pressing element 8 moves towards the strings 6 and the pressing material 2 presses against the strings 6. The pressing of the pressing material 2 against the strings 6 dampens the aliquot tones.

The second embodiment is schematically represented in FIG. 2.

The instrument in the embodiment is the piano or the upright piano. The device 1 for damping of aliquot tones is configured in a way that the strings 6 at the initial or final part of the active part of the strings, or at the initial or final fastening points 7 of the strings 6, via actuator 4, which is a foot pedal in this embodiment, get pressed through the pressing element 8 having the pressing material 2 fastened thereon, which is made from silicone rubber in this embodiment, wherein the pressing of the pressing material 2 causes the damping of aliquot tones.

The device 1 for damping of aliquot tones comprises the pressing material 2, with which the pressure against the strings 6 is carried out, the movable element 3 which causes a pressing force, and the actuator 4, with which the pressure against the strings 6 is actuated, such that the pressing element 8 having the pressing material 2 fastened thereon presses against the strings 6, thus dampening the aliquot tones.

When the actuator 4 is actuated, the movable element 3 presses the pressing element 8 having the pressing material 2 fastened thereon against the strings 6 at the beginning or the end of the active part of the strings or at the initial or final fastening point 7 of the strings 6.

The actuator 4 via the linkage 5, which is a hydraulic linkage in this embodiment, causes the movement of the movable element 3 which is a hydraulic cylinder in this embodiment, such that pressure is produced in the hydraulic cylinder and the piston extends, wherewith pressure is exerted on the pressing element 8 having the pressing material 2 fastened thereon, thus causing the movement of the pressing element 8 towards the strings 6, wherein the pressing material 2 presses against the string 6 and dampens the aliquot tones. The pressing element 8 is guided by the guides 9. As the pressing element 8 is moved, the movable element 3 actuates the return element 10, being a spring in this embodiment, more precisely it stretches it. Once the actuator 4 and hence the linkage 5 are no longer active, the spring returns to its original shape, it compresses, thus returning/moving the movable element 3 to its initial position, wherein the pressing element 8 and consequently the pressing material 2 move away from the strings 6.

As shown in FIG. 2, the movable elements 3 in the embodiment are hydraulic cylinders. Striking the actuator 4 increases the pressure within the hydraulic linkage, this triggers the functioning of the hydraulic cylinders which press against the pressing element 8 having the pressing material 2 fastened thereon. As the pressing element 8 and consequently the pressing material 2 presses against the string 6, it dampens the aliquot tones.

It is to be understood that the described solution can be executed in a different variant that does not change the essence of the invention.

The invention claimed is:

1. An aliquot tones damping device (1) for use in pianos or upright pianos with strings (6) mounted between two fastening points (7) said device comprising at least one pressing element (8) having a pressing material (2) fastened thereon, at least one movable element (3), at least one return element (10), a linkage (5), and an actuator (4), for actuating the movable element (3) via the linkage (5), characterized in that said at least one pressing element (8) is shaped as an elongated body extending at least over a group of strings (6) and transversely to said group of strings (6), and positioned above said group of strings (6), wherein by actuating the movable element (3), the pressing element (8) guided by guides (9) is moved in a direction toward said group of strings (6) and a pressure of the pressing material (2) against said group of strings (6) exerted at the beginning or at the end of the active parts of said group of strings (6) at an initial or at a final fastening point (7), thus dampening the aliquot tones of said group of strings (6), and by the movement of the movable element (3) the return element (10) is simultaneously actuated, and wherein, once the actuation is over, by the return element (10), the movable element (3) and hence the pressing element (8) is returned to its initial position.

2. Device according to claim 1, characterized in that the pressing material (2) is an elastic material selected from the materials that get slightly deformed when pressed against the strings (6), and part of the elastic material which is in contact with the string gets adapted in its shape to the shape of the string (6), wherewith the contact surface between the string (6) and the elastic material is increased, and returns to its initial position once the elastic material is released.

3. Device according to claim 1, characterized in that the linkage (5) is a mechanical one and formed as a cord, a rope, a steel cable, a steel bar or any other mechanical linkage.

4. Device according to claim 1, characterized in that the linkage (5) is formed as a hydraulic conductor, a pneumatic conductor, or an electrical conductor.

5. Device according to claim 1, characterized in that the linkage (5) is a wireless one, wherein the actuator (4) transmits a wireless signal that triggers the movable elements (3).

6. Device according to claim 1, characterized in that the movable element (3) is formed as a mechanical element of a non-circular shape, preferably of an ellipsoidal shape, and the actuation is carried out by rotating the mechanical element around its axis, wherein due to the non-circular shape of the mechanical element the point of pressing of the mechanical element changes, more precisely the radius is changed, which defines the distance from the turning point of the mechanical element to the point of pressing of the mechanical element.

7. Device according to claim 1, characterized in that the movable element (3) is formed as a hydraulic cylinder or a pneumatic cylinder or an electromagnet.

8. A method for damping of aliquot tones in pianos or upright pianos with strings (6) mounted between two fastening points (7), wherein the method is carried out on the device according to claim 1, characterized in that by the actuator (4) the movable element (3) is actuated via the linkage (5), wherein the movable element (3), while moving, presses against the pressing element (8) having the pressing material (2) fastened thereon, thus causing the movement of the pressing element (8) guided by guides (9) in a direction towards the strings (6), such that the pressing material (2) presses against the strings (6) so that the pressure against the strings (6) is done at the initial or final part of the active part of the strings (6) proximal to the initial or the final fastening point (7) of the strings (6) and dampens the aliquot tones of the strings (6), and the movable element (3), while moving, simultaneously actuates the return element (10), wherein, once the actuation is over, the return element (10) returns the movable element (3) to its initial position and the pressing element (8) and hence the pressing material (2) moves away from the strings (6).

9. Method according to claim 8, characterized in that when the device comprises two or more pressing elements (8) each extending over its individual group of strings (6), by the stepwise actuation of the actuator (4), individual groups of strings (6) are dampened by gradually turning on the device (1).

* * * * *